US009242826B2

(12) United States Patent
Bando et al.

(10) Patent No.: US 9,242,826 B2
(45) Date of Patent: Jan. 26, 2016

(54) METHOD AND APPARATUS FOR MANUFACTURING WET WIPES

(75) Inventors: Takeshi Bando, Kagawa (JP); Daisuke Miyake, Kagawa (JP); Ikue Hiramatsu, Kagawa (JP); Yoshihide Ishikawa, Kagawa (JP)

(73) Assignee: UNICHARM CORPORATION, Ehime-Ken (JP)

( * ) Notice: Subject to any disclaimer, the term of this patent is extended or adjusted under 35 U.S.C. 154(b) by 275 days.

(21) Appl. No.: 13/877,015

(22) PCT Filed: Sep. 16, 2011

(86) PCT No.: PCT/JP2011/071224

§ 371 (c)(1), (2), (4) Date: Jun. 10, 2013

(87) PCT Pub. No.: WO2012/043276

PCT Pub. Date: Apr. 5, 2012

(65) Prior Publication Data

US 2013/0298738 A1 Nov. 14, 2013

(30) Foreign Application Priority Data

Sep. 30, 2010 (JP) ..... 2010-222553

(51) Int. Cl.
*B65H 29/26* (2006.01)
*B65H 29/24* (2006.01)
(Continued)

(52) U.S. Cl.
CPC ..... *B65H 29/26* (2013.01); *B65B 25/145* (2013.01); *B65B 35/50* (2013.01);
(Continued)

(58) Field of Classification Search
CPC ..... B65H 29/26; B65H 35/04; B65H 29/32; B65H 2301/4213; B65H 2404/261; B65H 2701/18282; B65H 2404/513; B65H 2701/18272; B65H 2404/5131; B65H 29/242; B65H 2701/01; B65D 75/5838; B65D 83/0894; B65B 35/50; B65B 25/145; Y10T 83/202; Y10T 83/0448
USPC ..... 83/22, 24, 230, 149, 84–94
See application file for complete search history.

(56) References Cited

U.S. PATENT DOCUMENTS

RE11,417 E * 4/1894 Aspinwall ..... B65B 35/50 83/149
3,079,964 A * 3/1963 Oldershaw ..... A22C 25/20 221/224

(Continued)

FOREIGN PATENT DOCUMENTS

CN 101759059 A 6/2010
DE 3611354 A1 10/1987

(Continued)

OTHER PUBLICATIONS

Office Action dated Oct. 15, 2014, corresponding to Chinese patent application No. 201110303837.X.

(Continued)

*Primary Examiner* — Sean Michalski
(74) *Attorney, Agent, or Firm* — Hauptman Ham, LLP

(57) ABSTRACT

This method for producing wet wipes includes the following steps: a step for vertically folding non-woven cloth sheets; a step for impregnating the sheets with a chemical; a step for stacking the sheets; a step for cutting the sheets at predetermined lengths; a step for pulling the cut sheets away from a transporting conveyer provided with a suction mechanism by means of a pusher, and stacking the cut sheets; a step for pressing a bundle comprising the sheets; and a step for packaging the bundle. The pusher is disposed between the transporting conveyers. The blades of the pusher have a plurality of tooth sections. The pusher drops the sheets suctioned to the transporting conveyer downwards by means of moving vertically downwards.

5 Claims, 9 Drawing Sheets

(51) Int. Cl.

| | |
|---|---|
| ***B65H 29/32*** | (2006.01) |
| ***B65H 35/04*** | (2006.01) |
| ***B65B 25/14*** | (2006.01) |
| ***B65B 35/50*** | (2006.01) |
| ***B65D 75/58*** | (2006.01) |
| *A47K 10/42* | (2006.01) |
| *B65D 83/08* | (2006.01) |

(52) U.S. Cl.

CPC ..... *B65D 75/5838* (2013.01); *B65H 29/242* (2013.01); *B65H 29/32* (2013.01); *B65H 35/04* (2013.01); *A47K 2010/428* (2013.01); *B65D 83/0894* (2013.01); *B65H 2301/4213* (2013.01); *B65H 2404/261* (2013.01); *B65H 2404/513* (2013.01); *B65H 2404/5131* (2013.01); *B65H 2404/64* (2013.01); *B65H 2406/323* (2013.01); *B65H 2701/18272* (2013.01); *B65H 2701/18282* (2013.01); *B65H 2701/1924* (2013.01); *Y10T 83/0448* (2015.04); *Y10T 83/202* (2015.04)

(56) References Cited

U.S. PATENT DOCUMENTS

| | | | | | |
|---|---|---|---|---|---|
| 3,172,547 | A | * | 3/1965 | Holstebroe | B65B 35/50 414/791.7 |
| 3,328,027 | A | * | 6/1967 | Schmidtke | 271/197 |
| 3,395,915 | A | * | 8/1968 | Clausen et al. | 271/197 |
| 3,466,839 | A | * | 9/1969 | Temple | B65B 35/50 414/795.2 |
| 3,490,764 | A | | 1/1970 | Willer et al. | |
| 3,815,762 | A | * | 6/1974 | Hoke | B65G 59/00 271/10.15 |
| 3,919,827 | A | * | 11/1975 | Larson et al. | 53/429 |
| 4,350,330 | A | * | 9/1982 | Brown | B65H 1/26 271/12 |
| 4,433,599 | A | * | 2/1984 | Mundus et al. | 83/87 |
| 4,610,357 | A | * | 9/1986 | Nakamura | 206/449 |
| 4,905,843 | A | * | 3/1990 | Holbert | 209/571 |
| 5,092,236 | A | * | 3/1992 | Prim | B65H 29/46 100/220 |
| 5,141,112 | A | * | 8/1992 | Holbert | 209/653 |
| 5,161,350 | A | * | 11/1992 | Nakamura | 53/412 |
| 5,459,979 | A | * | 10/1995 | Tommasi | 53/439 |
| 5,564,892 | A | * | 10/1996 | Holbert | 414/793.1 |
| 5,687,641 | A | * | 11/1997 | Williamson et al. | 99/450.2 |
| 5,730,695 | A | * | 3/1998 | Hauschild | B65H 31/32 270/39.02 |
| 6,905,748 | B2 | * | 6/2005 | Sosalla | 428/43 |
| 7,063,500 | B1 | * | 6/2006 | Takahashi | 414/793.7 |
| 7,080,766 | B2 | * | 7/2006 | McEntee | B01J 19/0046 225/104 |
| 2003/0022781 | A1 | * | 1/2003 | Sosalla et al. | 493/463 |
| 2003/0164587 | A1 | * | 9/2003 | Gronbjerg | 271/197 |
| 2005/0207680 | A1 | * | 9/2005 | Schumacher et al. | 383/66 |
| 2007/0069453 | A1 | * | 3/2007 | Thomas et al. | 271/207 |
| 2009/0146360 | A1 | * | 6/2009 | Fokos | 270/58.3 |
| 2009/0286437 | A1 | * | 11/2009 | Cunningham et al. | 442/61 |
| 2010/0203291 | A1 | * | 8/2010 | Dyer et al. | 428/152 |
| 2011/0291354 | A1 | * | 12/2011 | Herrmann | B65H 29/242 271/303 |
| 2012/0103758 | A1 | * | 5/2012 | Zampollo | 198/418.3 |
| 2012/0128461 | A1 | * | 5/2012 | Zampollo | 414/788.9 |
| 2012/0132091 | A1 | * | 5/2012 | Roth et al. | 100/215 |
| 2013/0199710 | A1 | * | 8/2013 | Ishikawa et al. | 156/227 |
| 2014/0338287 | A1 | * | 11/2014 | Pelagatti | 53/202 |

FOREIGN PATENT DOCUMENTS

| | | | |
|---|---|---|---|
| JP | 557-098344 | A | 6/1982 |
| JP | H07-204118 | A | 8/1995 |
| JP | 2001-286410 | A | 10/2001 |
| JP | 2007-144053 | A | 6/2007 |

OTHER PUBLICATIONS

Office Action mailed Aug. 19, 2014, corresponds to Japanese patent application No. 2010-222553.

Supplementary European Search Report dated Sep. 11, 2015, corresponding to European patent application No. 11828836.4.

Office Action mailed Jul. 24, 2015, corresponding to Taiwanese patent application No. 100135591.

* cited by examiner

METHOD AND APPARATUS FOR MANUFACTURING WET WIPES

RELATED APPLICATIONS

The present application is a National Phase of International Application Number PCT/JP2011/071224, filed Sep. 16, 2011, and claims priority from Japanese Application Number 2010-222553, filed Sep. 30, 2010.

TECHNICAL FIELD

The present invention relates to a method and an apparatus for manufacturing wet wipes.

BACKGROUND ART

As a method for manufacturing wet wipes formed of a laminated body of sheets impregnated with a predetermined chemical, there are known methods disclosed in Patent Literatures 1 and 2.

A method disclosed in Patent Literature 1 has: a step of impregnating an original fabric with part of a predetermined chemical during conveyance of the original fabric before lamination; a step of squeezing out an excess of the predetermined chemical impregnated in the original fabric during conveyance of the original fabric; a step of laminating a plurality of original fabrics during conveyance of the original fabrics; and a step of impregnating the original fabrics with the rest of the predetermined chemical during conveyance of the original fabrics after lamination.

Furthermore, a method disclosed in Patent Literature 2 has: a step of impregnating an original fabric with a predetermined chemical during conveyance of the original fabric before lamination; a step of laminating the original fabric while folding it back during conveyance of the original fabric; a step of conveying the original fabric after lamination while compressing it in a thickness direction and thereafter cutting the original fabric; and the like.

The wet wipes manufactured by the methods disclosed in Patent Literatures 1 and 2 have a configuration of a so-called pop-up type that when one sheet is taken out of a container, the next one is also pulled out together and protruded from an outlet of the container.

CITATION LIST

Patent Literature

PTL 1: Japanese Patent Publication No. H7-204118
PTL 2: Japanese Patent Publication No. 2007-144053

SUMMARY OF INVENTION

However, the method disclosed in Patent Literature 1 has a problem that the impregnation step of a predetermined chemical requires two stages to be taken before and after lamination of the original fabric, thereby increasing the size of apparatus, and since the original fabric after lamination is impregnated with the predetermined chemical, the impregnation amount of the predetermined chemical has variability between the surface part and the center part of the laminated body of sheets.

Furthermore, the method disclosed in Patent Literature 2 has a problem that a predetermined chemical is squeezed out of the original fabric because the original fabric is folded back and compressed after impregnation with the predetermined chemical, thereby leading to a possibility that a product containing a desired amount of the predetermined chemical cannot be manufactured.

Furthermore, the wet wipes of the pop-up type described above have a problem that, if an impregnation rate of a predetermined chemical to the original fabrics is increased, the original fabrics are interconnected by means of a water screen of the predetermined chemical, which makes it difficult to take sheets out of the container one by one.

Thus, the present invention has been achieved in view of the aforementioned problem, and an object thereof is to provide a method and an apparatus for manufacturing wet wipes, by which wet wipes which can be easily taken out one by one can be manufactured by increasing an impregnation rate of a predetermined chemical and eliminating variability in an impregnation amount of the predetermined chemical.

A first feature of the present invention is summarized as a method for manufacturing wet wipes formed of a laminated body of sheets impregnated with a predetermined chemical, the method comprising: a step of conveying, by means of a conveyance device, an original fabric of a plurality of sheets in a state of laminated while being impregnated with the predetermined chemical and folded back; a step of making the laminated body of the sheets by cutting the original fabric of the sheets during conveyance, at a predetermined interval in a direction perpendicular to a conveyance direction on a surface of the sheets; a step of conveying, by means of the conveyance device, the laminated body of the sheets; and a step of detaching the laminated body of the sheets from the conveyance device, by means of a pusher which is provided with a projection protruded toward the surface of the sheets, reciprocates in a direction intersecting with the conveyance direction and the surface of the sheets.

Moreover, the feature of the present invention is summarized as a manufacturing device that manufactures wet wipes formed of a laminated body of sheets impregnated with a predetermined chemical, the manufacturing device comprising: a conveyance device; a cutting unit that makes the laminated body of the sheets by cutting an original fabric of a plurality of sheets at a predetermined interval in a direction perpendicular to a conveyance direction on a surface of the sheets, the plurality of sheets being conveyed by the conveyance device in a state of laminated while being impregnated with the predetermined chemical and folded back; and a dropping mechanism that reciprocates in a direction intersecting with the conveyance direction and the surface of the sheets, so as to detach the laminated body of the sheets conveyed by the conveyance device from the conveyance device, wherein the dropping mechanism is provided with a projection protruded toward the surface of the sheets.

DESCRIPTION OF EMBODIMENTS

First Embodiment of Present Invention

Figure 1:
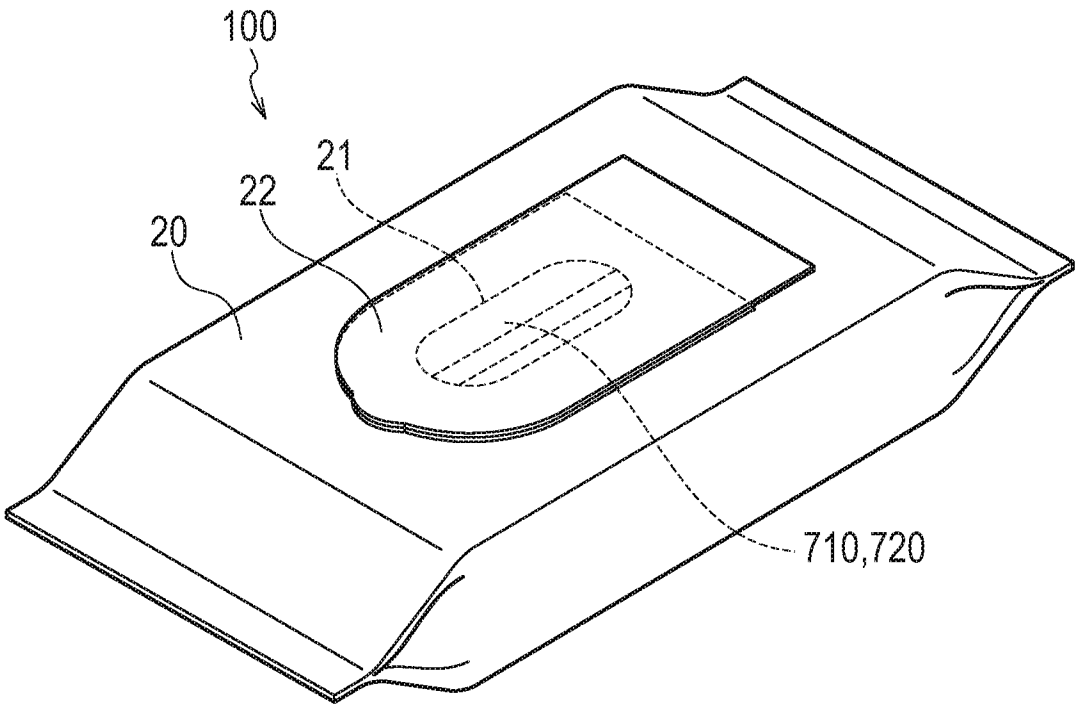
FIG. 1 is a perspective view of a package body of wet wipes manufactured by a manufacturing apparatus according to a first embodiment of the present invention.
Figure 2:
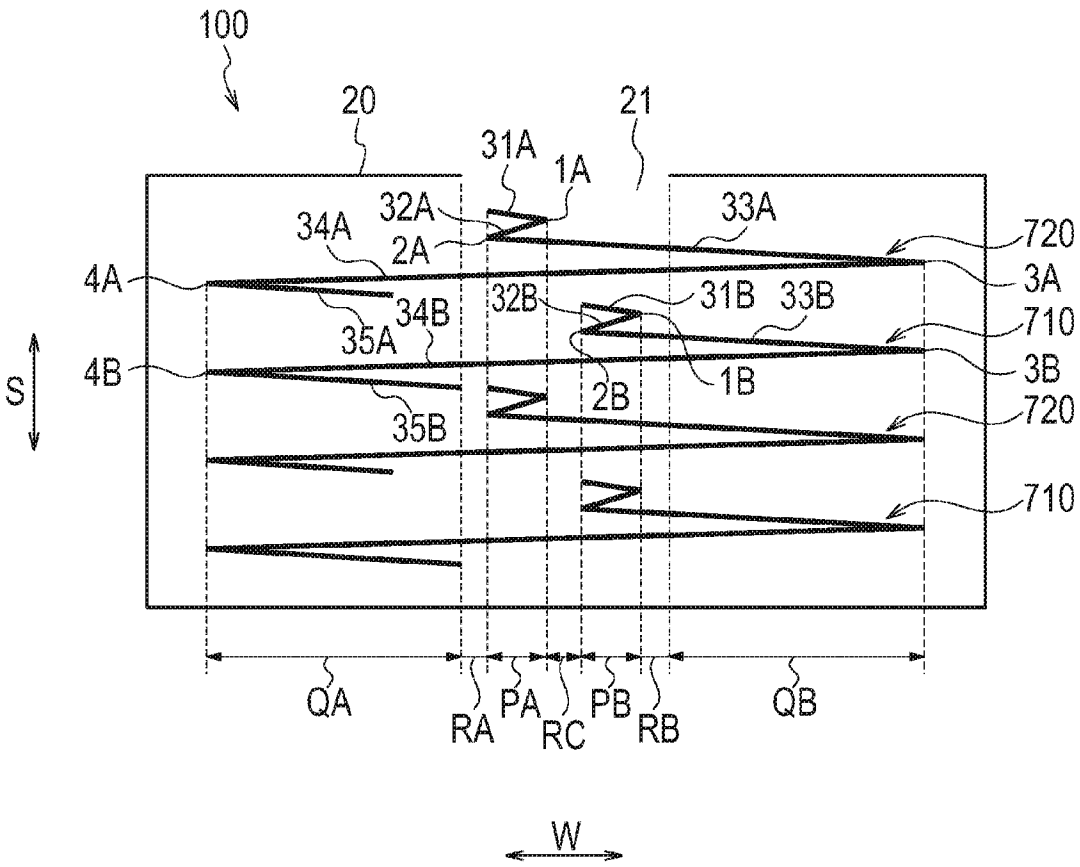
FIG. 2 is a view for showing a state in which the wet wipes manufactured by the manufacturing apparatus according to the first embodiment of the present invention are contained inside the package body.
Figure 3:
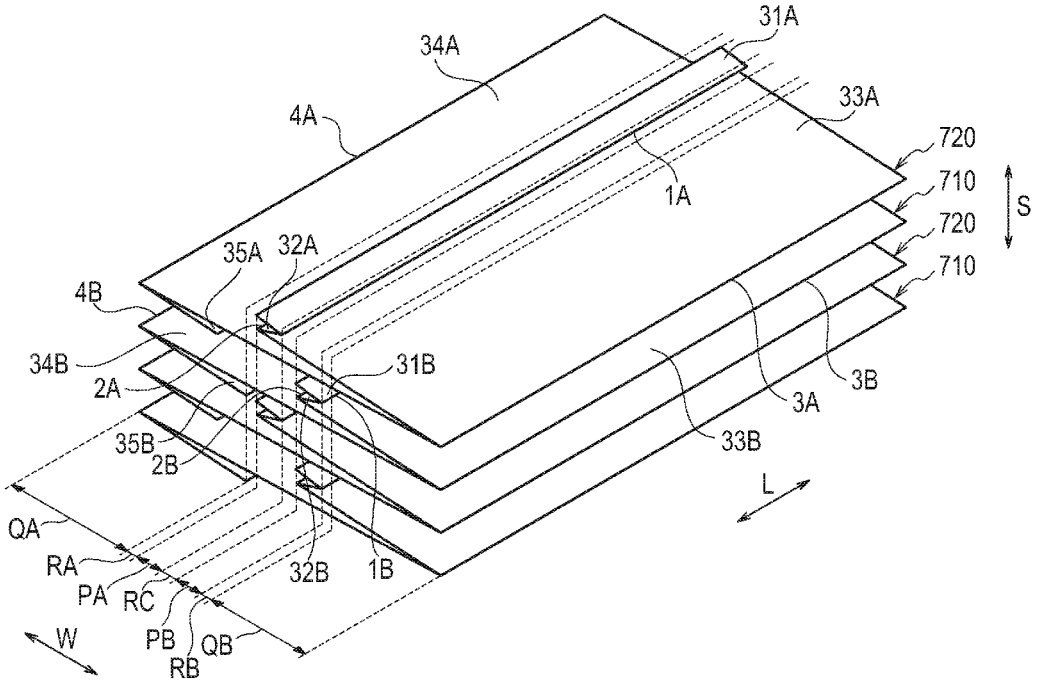
FIG. 3 is a view for showing a state in which the wet wipes manufactured by the manufacturing apparatus according to the first embodiment of the present invention are contained inside the package body.

With reference to FIGS. 1 to 3, wet wipes manufactured by a manufacturing apparatus 10 according to a first embodiment of the present invention are explained. Such wet wipes are formed of a laminated body of sheets 710, 720 impregnated with a predetermined chemical.

As shown in FIG. 1, a package body 100 of the wet wipes has: a package main body 20 having an opening portion 21; a label member 22 attached to the exterior face of the package main body 20 to cover the opening portion 21; and a laminated body of the sheets 710, 720 contained inside the package main body 20.

Each of the sheets 710, 720 is contained inside the package main body 20 in a state where these sheets are folded back as shown in FIGS. 2 and 3.

As shown in FIGS. 2 and 3, the sheet 720 has regions 31A, 32A, 33A, 34A, 35A, whereas the sheet 710 has regions 31B, 32B, 33B, 34B, 35B.

Herein, in the sheet 720, the regions 31A, 32A are folded back along a folding line 1A; the regions 32A, 33A are folded back along a folding line 2A; the regions 33A, 34A are folded back along a folding line 3A; and the regions 34A, 35A are folded back along a folding line 4A.

Similarly, in the sheet 710, the regions 31B, 32B are folded back along a folding line 1B; the regions 32B, 33B are folded back along a folding line 2B; the regions 33B, 34B are folded back along a folding line 3B; and the regions 34B, 35B are folded back along a folding line 4B.

Note that in the sheet 720, the folding lines 1A, 2A are provided between the folding lines 3A, 4A in a widthwise direction W, whereas in the sheet 710, the folding lines 1B, 2B are provided between the folding lines 3B, 4B in the widthwise direction W.

That is, in the sheet 720, a region between the folding lines 1A, 2A in the widthwise direction W has a four-layered structure formed by folding back the regions 31A, 32A, 33A, 34A, whereas the other region has a two-layered structure formed by folding back the regions 33A, 34A.

Therefore, the regions 31A, 32A rise in a lamination direction S of the laminated body while extending in one direction L of the laminated body.

That is, the regions 31A, 32A are folded back along the folding lines 1A, 2A to thereby configure a rising region PA which is formed in the laminated body so as to rise in the lamination direction S while extending in the one direction L.

Similarly, in the sheet 710, a region between the folding lines 1B, 2B in the widthwise direction W has a four-layered structure formed by folding back the regions 31B, 32B, 33B, 34B, whereas the other region has a two-layered structure formed by folding back the regions 33B, 34B.

Therefore, the regions 31B, 32B rise in a lamination direction S of the laminated body while extending in the one direction L of the laminated body.

That is, the regions 31B, 32B are folded back along the folding lines 1B, 2B to thereby configure a rising region PB which is formed in the laminated body so as to rise in the lamination direction S while extending in the longitudinal direction L.

Furthermore, one region (that is, the rising region PA) between the folding lines 1A, 2A in the widthwise direction W is arranged so as not to be overlapped with the other region (that is, the rising region PB) between the folding lines 1B, 2B in the direction W.

Furthermore, in the rising regions PA, PB, the sheets 710, 720 adjacent to each other in the lamination direction S are laminated in close contact with each other with a predetermined chemical intervened therebetween.

Herein, in regions RA, RB, RC adjacent to the rising regions PA, PB, since a gap is formed between the sheets 710, 720 adjacent to each other in the lamination direction S, these sheets are not laminated in close contact with each other and not with the predetermined chemical intervened therebetween.

Note that the wet wipes manufactured with the manufacturing apparatus 10 according to the first embodiment of the present invention are not configured as the aforementioned pop-up type. Therefore, even in a case where the sheet 720 is taken out through the opening portion 21 of the package main body 20, the sheet 710 is not pulled up together to be protruded from the opening portion 21.

That is, after taking out the sheet 720 through the opening portion 21 of the package main body 20 by grabbing and pulling up the regions 31A, 32A (that is, the rising region PA of the sheet 720), a user can take out the sheet 710 by grabbing and pulling up the regions 31B, 32B (that is, the rising region PB of the sheet 710).

Hereinafter, with reference to FIG. 4, a method for manufacturing wet wipes according to the present embodiment is briefly explained.

Figure 4:
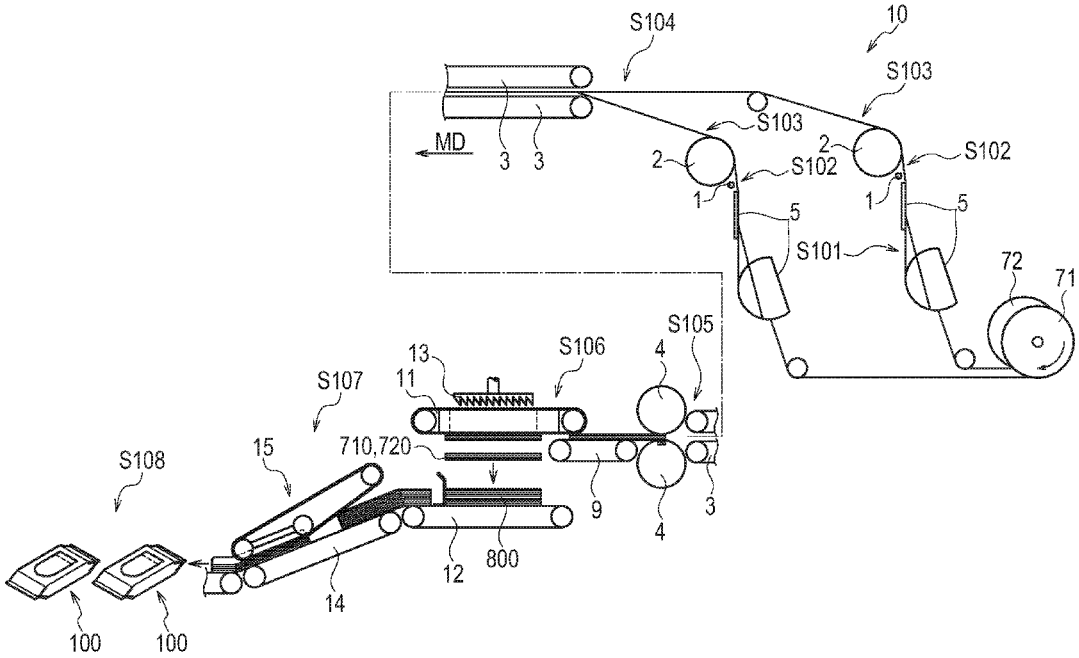
FIG. 4 is a schematic view of the manufacturing apparatus according to the first embodiment of the present invention.
Figure 5:
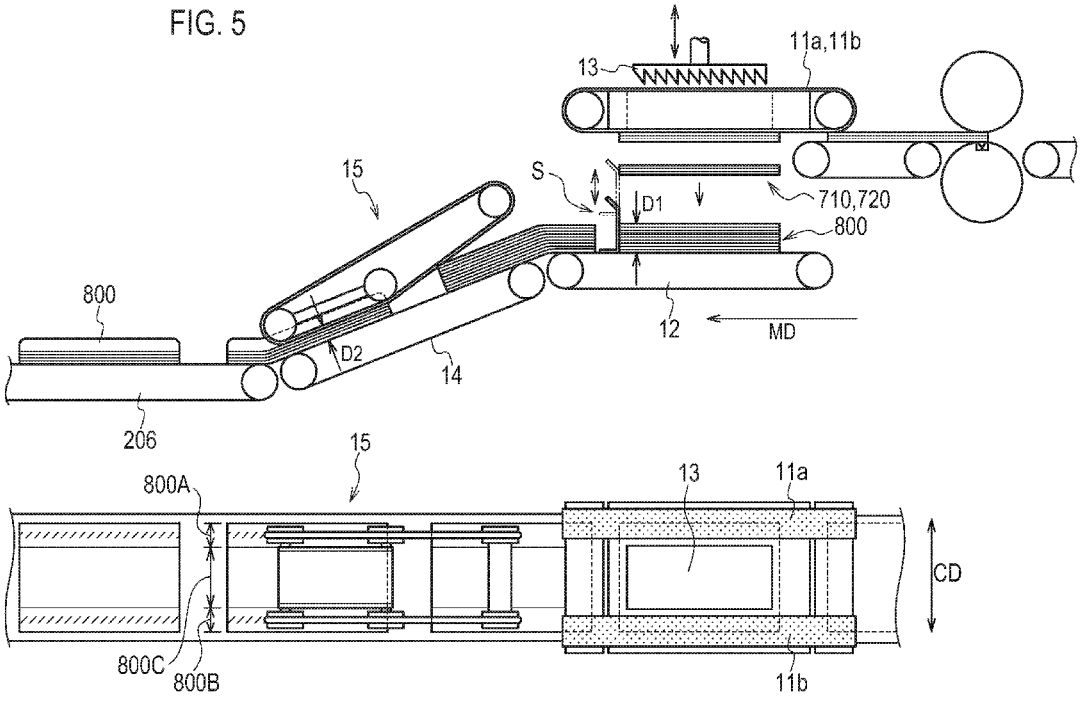
FIG. 5 is a view for illustrating devices used in a laminating step and a pressing step of the manufacturing apparatus according to the first embodiment of the present invention.

As shown in FIG. 4, in step S101, the folding unit 5 folds respective sheets 71, 72 having been sent out from a wound state in a roller shape, into a predetermined shape (specifically, a shape shown in FIGS. 2 and 3) on a side not in contact with a conveyance device.

For example, the sheets 71, 72 have a basis weight of 25 $g/m^2$ to 100 $g/m^2$, and are made of; fibers made of a hydrophilic fiber such as rayon, cotton, or pulp, and a simple substance such as PET, PP, PE, or acrylic; or hydrophobic composite fibers having a sheath-core structure or a side-by-side structure.

Furthermore, the sheets 71, 72 are a nonwoven fabric shaped in a sheet-like form by a spun lace method, an air-laid method, a direct spinning method, or the like, and these sheets are required to include a hydrophilic fiber in terms of permeability of the predetermined chemical at the time of impregnation of the predetermined chemical.

In step S102, an impregnating unit 1 impregnates each of the folded sheets 71, 72 with a predetermined amount of predetermined chemical from a side in contact with the conveyance device (a side of a conveyance roller 2).

In step S103, each of the sheets 71, 72 impregnated with the predetermined chemical is conveyed in contact with the surface of the conveyance roller 2.

In step S104, a conveyer 3 laminates each of the sheets 71, 72 impregnated with the predetermined chemical.

Specifically, with the conveyer 3, the sheet 72 with its surface impregnated with the predetermined chemical being faced to the side in contact with the conveyance device is laminated from the side not in contact with the conveyance device, on the sheet 71 with its surface impregnated with the predetermined chemical being faced to the side in contact with the conveyance device.

In step S105, a cutting unit 4 cuts the sheets 71, 72 conveyed by the conveyer 3, into the sheets 710, 720 with a predetermined size.

In step S106, by means of a pusher 13 provided with projections protruded toward the surface of the sheets 710, 720, the laminated body formed of the cut-out sheets 710, 720 is crossed in the conveyance direction while being shifted in a direction intersecting with the surface of the sheets 710, 720 (in a vertically downward direction from the conveyance surface in this embodiment), thereby being dropped from the conveyance device, resulting in a sheet bundle 800 formed by laminating a predetermined number of laminated bodies made of the sheets 710, 720. Thereafter, in pressing step S107, the sheet bundle 800 made of the cut-out sheets 710, 720 is conveyed while being pressed. In packaging step S108, the sheet bundle 800 is packaged in the package main body 20.

Hereinafter, with reference to FIGS. 4 to 7, each function of the manufacturing apparatus 10 according to the present embodiment is explained.

As shown in FIG. 4, the manufacturing apparatus 10 has: the folding unit 5; the impregnating unit 1; the conveyance roller 2; conveyors 3, 9, 11, 12; the cutting unit 4; the pusher 13; and a pressing device 15. Herein, in the manufacturing apparatus 10, the conveyance roller 2 and the conveyors 3, 9 make up a conveyance device configured to continuously convey the plurality of sheets 71, 72. Furthermore, the conveyers 11, 12, 14 make up a conveyance device configured to continuously convey the sheet bundles 800.

The folding unit 5 is configured to fold back each of the sheets 71, 72 on a side not in contact with the conveyance device. Specifically, the folding unit 5 is configured to fold back each of the sheets 71, 72 so that the sheets 71, 72 are formed in a shape shown in FIGS. 2 and 3.

Specifically, the folding unit 5 is configured so that: the regions 31A, 32A, 33A (or 31B, 32B, 33B) including one side edge of the sheet 72 (or 71) are folded back on a side not in contact with the conveyance device, along the folding line 3A (or 3B) in the conveyance direction MD; thereafter the regions 31A, 32A (or 31B, 32B) including one side edge of the sheet 72 (or 71) are folded back on the side not in contact with the conveyance device, along the folding line 2A (or 2B) in the conveyance direction MD; and thereafter, the region 31A (or 31B) including one side edge of the sheet 72 (or 71) is folded back on the side not in contact with the conveyance device, along the folding line 1A (or 1B) in the conveyance direction MD.

Furthermore, the folding unit 5 is configured so that the region 35A (or 35B) including the other side edge of the sheet 72 (or 71) is folded back on a side in contact with the conveyance device, along the folding line 4A (or 4B) in the conveyance direction MD.

The impregnating unit 1 is configured to impregnate each of the folded sheets 71, 72 with the predetermined chemical, from the side in contact with the conveyance device.

For example, the impregnating unit 1 may be configured to push out the predetermined chemical by a predetermined amount from a chemical tank by using a proportioning pump. As a result, the predetermined amount of predetermined chemical is discharged from a pore provided in the impregnating unit 1 and comes in contact with the sheets 71, 72, so that each of the sheets 71, 72 is impregnated with the predetermined amount of predetermined chemical.

Furthermore, the impregnating unit 1 may be configured to impregnate the sheets 71, 72 with the predetermined chemical having weight of 3.5 (between 3 and 4) times heavier than the sheets 71, 72, for example.

Note that a weight rate (that is, an impregnation rate) of the predetermined chemical to be impregnated, with respect to the sheets 71, 72 is appropriately adjustable by the impregnating unit 1.

Herein, an impregnation rate required for the sheets 71, 72 to adhere to the surface of the conveyance roller 2 and for the sheet 72 to adhere to the top of the sheet 71 is 1.5 times or more in a case of using as the sheets 71, 72, a spun lace nonwoven fabric of 38 $g/m^2$ having a rayon fiber as a main constituent, for example.

Furthermore, as a method for applying a predetermined chemical, the impregnating unit 1 may adopt a method for attaching a predetermined chemical in a droplet form or in a mist form to the sheets 71, 72. However, the above-described method is preferable in consideration of impregnation efficiency and process pollution of chemical at the time when surfaces of the sheets 71, 72, which are impregnated with the predetermined chemical, are brought in contact with the surface of the conveyance roller 2.

The conveyance roller 2 is connected to a driving source and is a driving roller with a smooth surface, configured to rotate by itself.

The conveyor 3 is configured to convey each of the sheets 71, 72 at an approximately equal conveyance speed to the conveyance roller 2.

The cutting unit 4 is configured to cut the laminated body formed by laminating the plurality of sheets 71, 72 in a state where the sheets 71, 72 impregnated with the predetermined chemical are folded back. For example, the cutting unit 4 is configured so that a cutter roller having a cutting blade on its surface and an anvil roller having a smooth surface cut the plurality of continuously-conveyed sheets at a predetermined interval in a direction perpendicular to the conveyance direction.

Furthermore, like the conveyor 3, the conveyor 9 may be provided at both the upside and downside. In such a case, the laminated body of the sheets 710, 720 is conveyed while being sandwiched between an upper conveyer arranged at the upside and a lower conveyer arranged at the downside. This upper conveyor may be provided with a concave portion and a convex portion.

As a result, the laminated body of the sheets 710, 720 after being cut by the cutting unit 4 is improved in its transfer ability and conveyance stability with respect to the conveyer 9.

Herein, a conveyance speed of the conveyor 9 is 3% higher than the conveyor 3 and the cutting unit 4.

The conveyer 11 has conveyers 11*a*, 11*b* arranged at a predetermined interval in a cross direction CD intersecting with the conveyance direction MD. The conveyers 11*a*, 11*b* are provided with a suction mechanism (not shown) to enable the cut-out sheets 710, 720 conveyed by the conveyer 9 to be conveyed with their outer ends in the widthwise direction being adsorbed to the conveyance surface. The pusher 13 is arranged between the conveyers 11*a*, 11*b*.

The pusher 13 is configured to intersect with the conveyance direction MD and reciprocate in the direction intersecting with the surface of the sheets 710, 720 (a vertically downward direction from the conveyance surface in this embodiment) so as to detach the sheets 710, 720 conveyed by the conveyer 11 from the conveyance surface of the conveyers 11*a*, 11*b* and drop down the sheets 710, 720 from the conveyers 11*a*, 11*b*.

Figure 6:
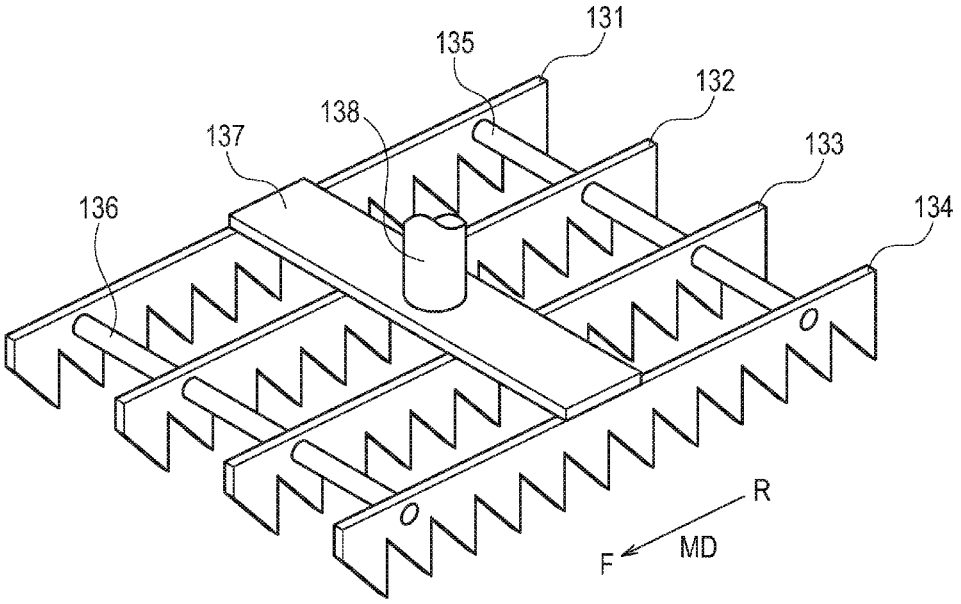
FIG. 6 is a view for illustrating a configuration of a pusher in the manufacturing apparatus according to the first embodiment of the present invention.
Figure 7:
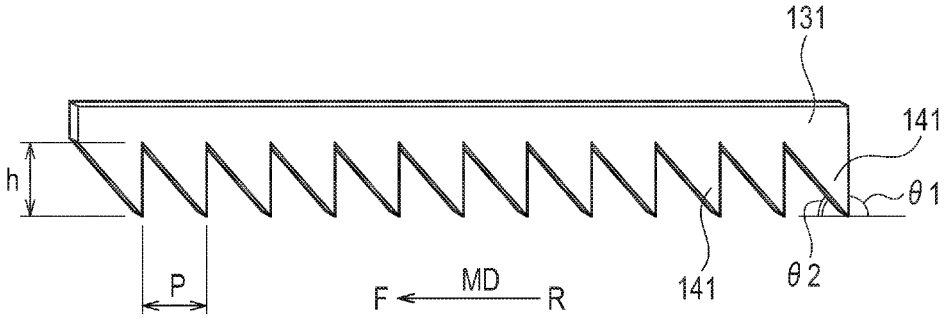
FIG. 7 is a view for illustrating a configuration of a blade of the pusher in the manufacturing apparatus according to the first embodiment of the present invention.

As shown in FIGS. 6, 7, the pusher 13 has projections protruded toward the surface of the sheets 710, 720. Specifically, the pusher 13 has blades 131 to 134, connecting portions 135, 136, 137 for connecting the blades, and a supporting portion 138 for supporting the blades 131 to 134.

The blades 131 to 134 have a plurality of tooth portions 141. One tooth portion 141 is configured so that inclination angle θ1 at an inlet side of the sheet in the conveyance direction MD (a rear side (upper-stream side) R in the conveyance direction MD) is greater than inclination angle θ2 at an outlet side of the sheet (a front side (down-stream side) F in the conveyance direction MD). As one example, a height h from troughs to tops of the tooth portions 141 is 10 mm and an interval (pitch) p between the tops of the tooth portions 141 is 15 mm. In the pusher 13 according to the embodiment, expressions of θ1=90° and θ2=60° hold.

The number of blades making up the pusher 13 is not limited to four as shown in FIG. 6. For example, the pusher 13 may be formed of six blades.

Figure 8:
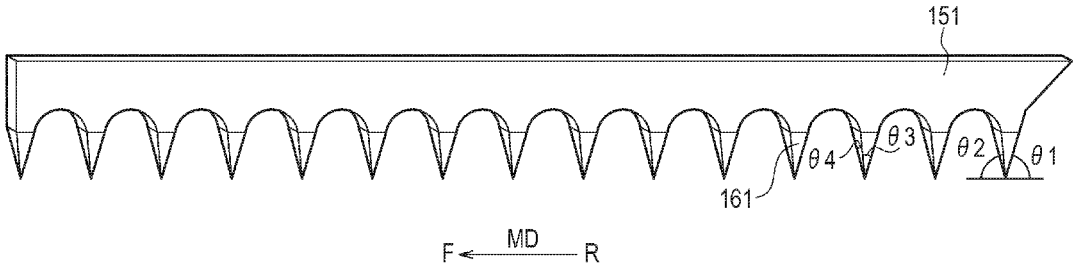
FIG. 8 is view for illustrating a modification of the blade of the pusher in the manufacturing apparatus according to the first embodiment of the present invention.
Figure 9:
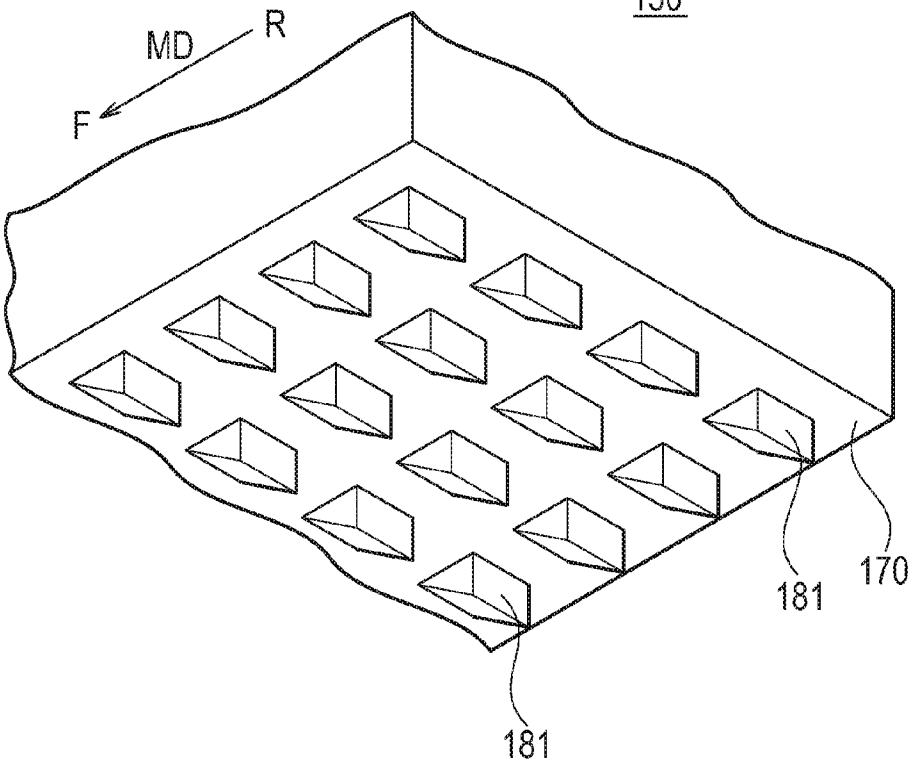
FIG. 9 is a view for illustrating a configuration of a modification of the pusher in the manufacturing apparatus according to the first embodiment of the present invention.

FIGS. 8 and 9 show a modification of projections formed in the pusher 13. The blades 131 to 134 are not limited to the shape shown in FIG. 7. That is, the expression of θ1=90° is not necessarily always satisfied. FIG. 8 shows a modification of the blade. As shown in FIG. 8, the blade 151 has a plurality of tooth portions 161. Inclination angle θ1 on a rear side R in the conveyance direction MD of the tooth portions 161 is greater than angle θ2 on a front side F, and expressions of θ1≠90° and θ1<90° hold. Furthermore, in the thickness direction of the blade 151, the blade 151 tapers toward the front tips of the tooth portions 161. In the embodiment, the blade 151 is configured to satisfy expression of θ3=θ4=20°.

As shown in FIG. 9, a pusher 130 shown as a modification is provided with projections 181 in a base 170. Like the tooth portions 141, the projections 181 are configured so that angle θ1 at an inlet side of the sheet in the conveyance direction MD (a rear side R in the conveyance direction MD) is greater than angle θ2 at an outlet side of the sheet (a front side F in the conveyance direction MD).

By means of the pusher 13, the sheet bundle 800 is formed by laminating the predetermined number of laminated bodies of the sheets 710, 720 detached from the conveyers 11*a*, 11*b*. Thereafter, a stopper S is released and the sheet bundle 800 is conveyed by the conveyer 12 toward the pressing device 15.

The pressing device 15 is configured so that the sheet bundle 800 is conveyed while both end portions of the sheet bundle 800 formed by laminating the cut-out sheets 710, 720 are pressed by the pressing portion from the side not in contact with the conveyer 14.

With the manufacturing method and the manufacturing apparatus 10 according to the present embodiment, the sheets 71, 72 are conveyed while maintaining a state of being impregnated with the predetermined chemical, without requiring steps at a stage prior to making the sheet bundle 800, such as a step of impregnating the sheets 710, 720 with part of chemical while the sheets are being conveyed, a step of squeezing out an excess of the predetermined chemical impregnated in the sheets 710, 720 while the sheets are being conveyed, and a step of impregnating the sheet bundle 800 after lamination, with the rest of predetermined chemical. Therefore, it is possible to manufacture wet wipes by which the rate of impregnation of the sheets 710, 720 with the predetermined chemical is increased and variability in the impregnation amount of the predetermined chemical is eliminated.

However, with the wet wipes other than a so-called pop-up type, like the present embodiment, in which the sheets are not interconnected, the sheets detached from the conveyance surface flow by inertia in the conveyance direction in a step of making the laminated body of cut-out sheets, which possibly leads to a problem that the edges of the laminated body become uneven. Furthermore, this unevenness in the laminated body may make the sheets unable to be taken one by one. That is, there is concern about reduction in the easiness of taking sheets out.

On the other hand, by the manufacturing method according to the present embodiment, the pusher 13 provided with the projections is used in the lamination step S106 in which the sheets 710, 720 are shifted vertically downward from the conveyance surface and dropped down from the conveyer 11. When the pusher 13 is pressed down, the projections are caught in the surface of the sheets 710, 720 thereby preventing the sheets 710, 720 from flowing in the conveyance direction MD.

Accordingly, the edges of the sheet bundle 800 formed by laminating the sheets 710, 720 can be evened up.

It is desirable that a configuration be made so that angle θ1 at an outlet side of the sheet in the conveyance direction MD (a rear side R in the conveyance direction MD) is greater than angle θ2 at an outlet side of the sheet (a front side F in the conveyance direction MD). With a configuration which satisfies the expression of θ1>θ2, the tooth portions 141 of the blades 131 to 134 are hardly slid across the surface of the sheets 710, 720, so that the sheets 710, 720 can be reliably prevented from flowing by inertia in the conveyance direction.

The edges of the sheet bundle 800 can be evened up, so that reduction in the easiness of taking sheets out, which is caused by the fact that a plurality of sheets is taken out all stuck together, can be prevented.

In the present embodiment, as long as at least the expressions of θ1>60° and 10°<θ3<45° hold, the tooth portions 141 (or the tooth portions 161) of the blades 131 to 134 are not slid across the surface of the sheets 710, 720 even in a case where θ1 is less than or equal to 90°, so that the sheets 710, 720 can be sufficiently prevented from shifting.

Thus, the present invention has been explained in detail by using the above-described embodiments; however, it is obvious that for persons skilled in the art, the present invention is not limited to the embodiments explained herein. The present invention can be implemented as corrected and modified modes without departing from the gist and the scope of the present invention defined by the claims. Therefore, the description of the specification is intended for explaining the example only and does not impose any limited meaning to the present invention.

In addition, the entire content of Japanese Patent Application No. 2010-222553 (filed on Sep. 30, 2010) is incorporated in the present specification by reference.

INDUSTRIAL APPLICABILITY

Thus, the present invention has been achieved in view of the aforementioned problem, and an object thereof is to provide a method and an apparatus for manufacturing wet wipes, by which wet wipes which can be easily taken out one by one can be manufactured by increasing an impregnation rate of a predetermined chemical and eliminating variability in an impregnation amount of the predetermined chemical.

The invention claimed is:

1. A method of manufacturing wet wipes formed of a stacked body of sheets impregnated with a predetermined chemical, the method comprising:

conveying, in a conveyance direction, a fabric of a plurality of sheets in a state where the sheets are folded, impregnated with the predetermined chemical, and stacked on each other;

cutting the stacked sheets during conveyance, at a predetermined interval in a cross direction perpendicular to the conveyance direction to obtain the stacked body of the sheets; then conveying, by a conveyance device, the stacked body of the sheets; and detaching the stacked body of the sheets from the conveyance device, by means of a pusher which is provided with a projection protruding toward a surface of the stacked body of the sheets, and reciprocates in a direction intersecting with the conveyance direction and the surface of the stacked sheets, wherein the projection has a plurality of tooth portions, each of the tooth portions has an inlet side and an outlet side downstream of the inlet side in the conveyance direction, the inlet and outlet sides of the tooth portion are inclined with respect to the conveyance direction at first and second inclination angles, and the first inclination angle between the inlet side and the conveyance direction is greater than the second inclination angle between the outlet side and the conveyance direction.

2. The manufacturing device according to claim 1, wherein the tooth portions have tips spaced away from each other in the conveyance direction at a predetermined distance.

3. A manufacturing device for manufacturing wet wipes formed of a stacked body of sheets impregnated with a predetermined chemical, the manufacturing device comprising:

a cutting unit configured to cut a fabric of a plurality of sheets in a state where the sheets are folded, impregnated with the predetermined chemical, and stacked on each other, wherein the cutting unit is configured to cut the fabric, while the fabric being conveyed in a conveyance direction, at a predetermined interval in a cross direction perpendicular to the conveyance direction to obtain the stacked body of the sheets; and a conveyance device configured to convey the stacked body of the sheets in the conveyance direction downstream from the cutting unit;

a dropping mechanism configured to reciprocate in a direction intersecting with the conveyance direction and a surface of the stacked body of the sheets, so as to detach the stacked body of the sheets conveyed by the conveyance device from the conveyance device, wherein the dropping mechanism has a projection protruding toward the surface of the stacked body of the sheets, the projection has a plurality of tooth portions, and the tooth portions have tips spaced away from each other in the conveyance direction at a predetermined distance.

4. The manufacturing device according to claim 3, wherein the projection comprises a blade having the plurality of tooth portions.

5. The manufacturing device according to claim 3, wherein each of the tooth portions has an inlet side and an outlet side downstream of the inlet side in the conveyance direction, the inlet and outlet sides of the tooth portion are inclined with respect to the conveyance direction to define first and second inclination angles, and the first inclination angle between the inlet side and the conveyance direction is greater than the second inclination angle between the outlet side and the conveyance direction.

* * * * *